US011563272B2

(12) United States Patent
Bai et al.

(10) Patent No.: US 11,563,272 B2
(45) Date of Patent: Jan. 24, 2023

(54) MULTI-BAND ANTENNA AND COMMUNICATIONS DEVICE

(71) Applicant: HUAWEI TECHNOLOGIES CO., LTD., Shenzhen (CN)

(72) Inventors: Xue Bai, Dongguan (CN); Naibiao Wang, Dongguan (CN); Guoqing Xie, Dongguan (CN); Weihong Xiao, Dongguan (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 57 days.

(21) Appl. No.: 17/206,534

(22) Filed: Mar. 19, 2021

(65) Prior Publication Data

US 2021/0210854 A1 Jul. 8, 2021

Related U.S. Application Data

(63) Continuation of application No. PCT/CN2019/106174, filed on Sep. 17, 2019.

(30) Foreign Application Priority Data

Sep. 20, 2018 (CN) ..... 201811099935.4

(51) Int. Cl.
*H01Q 5/30* (2015.01)
*H01Q 5/40* (2015.01)
(Continued)

(52) U.S. Cl.
CPC ..... *H01Q 5/307* (2015.01); *H01Q 5/42* (2015.01); *H01Q 5/45* (2015.01); *H01Q 19/108* (2013.01); *H01Q 21/26* (2013.01)

(58) Field of Classification Search
CPC ..... H01Q 5/307; H01Q 19/108; H01Q 21/26; H01Q 5/48; H01Q 5/42; H01Q 1/36; H01Q 5/50; H01Q 15/14
See application file for complete search history.

(56) References Cited

U.S. PATENT DOCUMENTS 6,323,820 B1 * 11/2001 Haunberger ..... H01Q 5/50 343/822
9,698,486 B2 7/2017 Shooshtari et al.
(Continued)

FOREIGN PATENT DOCUMENTS

CN 102868017 A 1/2013
CN 103840254 A 6/2014
(Continued)

*Primary Examiner* — Vibol Tan
(74) *Attorney, Agent, or Firm* — Rimon PC

(57) ABSTRACT

Embodiments of the present invention pertain to the field of communications technologies and disclose a multi-band antenna and a communications device. The multi-band antenna includes a reflection panel, at least one high-frequency unit, and at least one low-frequency unit. Each high-frequency unit includes a balun structure, a coupling structure, and a radiation arm structure. The balun structure includes two balun sub-structures, the coupling structure includes two coupling sub-structures, and the radiation arm structure includes two radiation arms. The high-frequency unit and the low-frequency unit are disposed on the reflection panel. Each coupling sub-structure is separately electrically connected to one balun sub-structure and one radiation arm. The coupling sub-structure is configured to transmit a signal whose frequency is higher than a preset threshold, and block a signal whose frequency is lower than the preset threshold.

10 Claims, 4 Drawing Sheets

Multi-band antenna

(51) Int. Cl.

| | |
|---|---|
| ***H01Q 5/307*** | (2015.01) |
| ***H01Q 19/10*** | (2006.01) |
| ***H01Q 21/26*** | (2006.01) |
| ***H01Q 5/45*** | (2015.01) |
| ***H01Q 5/42*** | (2015.01) |

(56) References Cited

U.S. PATENT DOCUMENTS

| | | | | |
|---|---|---|---|---|
| 9,711,871 | B2 * | 7/2017 | Jones | H01Q 21/28 |
| 9,819,084 | B2 * | 11/2017 | Zimmerman | H01Q 5/48 |
| 11,322,834 | B2 * | 5/2022 | Daojian | H01Q 5/50 |
| 2015/0070234 | A1 | 3/2015 | Jones | |
| 2016/0285169 | A1 | 9/2016 | Shooshtari et al. | |
| 2018/0191083 | A1 | 7/2018 | Daojian et al. | |
| 2021/0194136 | A1 * | 6/2021 | Chen | H03H 7/42 |

FOREIGN PATENT DOCUMENTS

| | | | |
|---|---|---|---|
| CN | 103730728 | B | 9/2016 |
| CN | 105960737 | A | 9/2016 |
| CN | 106104914 | A | 11/2016 |
| CN | 107134639 | A | 9/2017 |
| CN | 107546489 | A | 1/2018 |
| EP | 3245691 | A1 | 11/2017 |
| WO | 2016114810 | A1 | 7/2016 |
| WO | 2017035726 | A1 | 3/2017 |

* cited by examiner

MULTI-BAND ANTENNA AND COMMUNICATIONS DEVICE

CROSS-REFERENCE TO RELATED APPLICATIONS

This application is a continuation of International Application No. PCT/CN2019/106174, filed on Sep. 17, 2019, which claims priority to Chinese Patent Application No. 201811099935.4, filed on Sep. 20, 2018. The disclosures of the aforementioned applications are hereby incorporated by reference in their entireties.

TECHNICAL FIELD

This application relates to the field of communications technologies, and in particular, to a multi-band antenna and related communications device.

BACKGROUND

A multi-band antenna is an antenna having a plurality of operating frequency bands, and includes a reflection panel, at least one high-frequency unit, and at least one low-frequency unit. Each high-frequency unit includes a balun structure and a radiation arm structure. The radiation arm structure is two symmetrically disposed radiation arms. Ends that are of the two radiation arms and that are close to each other are separately electrically connected to the balun structure. The radiation arm structure is configured to radiate an electromagnetic wave to the outside. The balun (balance-unbalance) structure is a transliteration abbreviation for an English phrase "balanced to unbalanced transformer." The balun structure is a device configured to implement a signal connection between the radiation arm structure of the antenna and a cable. The distance from a ground terminal of the balun structure to a connection end of the balun structure and the radiation arm structure plus an arm length of one radiation arm of the radiation arm structure is a preset length value. The preset length value is determined based on an operating frequency band of the high-frequency unit. Once the operating frequency band of the high-frequency unit is determined, the preset length value is also determined. Sometimes, the preset length value is close to a quarter of a wavelength of the low-frequency unit. In this case, the balun structure of the high-frequency unit and the radiation arm of the balun structure may be equivalent to a monopole antenna whose operating frequency is close to a frequency of the low-frequency unit. The monopole antenna is an antenna that has a vertical radiation arm and in which an arm length of the radiation arm is equal to a quarter of a wavelength corresponding to an operating frequency of the antenna.

In the process of implementing this application, it was discovered that the related technology has at least the following problem:

When the low-frequency unit operates, the equivalent monopole antenna generates a low-frequency induced current due to the impact of an electromagnetic wave of the low-frequency unit. The low-frequency induced current causes the monopole antenna to radiate a low-frequency electromagnetic wave to the outside. The frequency of the electromagnetic wave from the equivalent monopole antenna is approximately the same as the frequency of the electromagnetic wave radiated by the low-frequency unit. This causes interference to signals radiated and transmitted by the low-frequency unit.

SUMMARY

To resolve the above described problem in related technologies, embodiments of the present invention provide a multi-band antenna and a communications device. The technical solutions are as follows:

According to a first aspect, a multi-band antenna is provided. As shown in FIG. 1 and FIG. 2, the multi-band antenna includes a reflection panel 1, at least one high-frequency unit 2, and at least one low-frequency unit 3. As shown in FIG. 3, each high-frequency unit 2 includes a balun structure 21, a coupling structure 22, and a radiation arm structure 23. The balun structure 21 includes two balun sub-structures 211, the coupling structure 22 includes two coupling sub-structures 221, and the radiation arm structure 23 includes two radiation arms 231. The at least one high-frequency unit 2 and the at least one low-frequency unit 3 are disposed on the reflection panel 1. In each high-frequency unit 2, each coupling sub-structure 221 is separately electrically connected to one balun sub-structure 211 and one radiation arm 231. The coupling sub-structure 221 is configured to transmit a signal whose frequency is higher than a preset threshold, and block a signal whose frequency is lower than the preset threshold.

The high-frequency unit 2 and the low-frequency unit 3 may also be referred to as dipoles. A dipole antenna is an antenna that includes a pair of symmetrically disposed radiation arms and in which two ends of the two radiation arms that are adjacent to each other are separately connected to a feeder.

In the solution shown in this embodiment of the present invention, as shown in FIG. 1 and FIG. 2, two high-frequency units 2 of the multi-band antenna may be interspersed and disposed on the reflection panel 1, and two low-frequency units 3 may also be interspersed and disposed on the reflection panel 1, to save space of the multi-band antenna. In this embodiment, for ease of description of a structure of the high-frequency unit 2, one high-frequency unit 2 may be used as an example. Each high-frequency unit 2 includes not only the balun structure 21 and the radiation arm structure 23, but also the coupling structure 22 disposed on a connection line between the balun structure 21 and the radiation arm structure 23. The coupling structure 22 is configured to transmit a signal whose frequency is higher than the preset threshold, and block a signal whose frequency is lower than the preset threshold. Because the multi-band antenna belongs to a dipole antenna, the radiation arm structure 23 includes the two radiation arms 231. Correspondingly, the balun structure 21 also includes the two balun sub-structures 211, and the coupling structure 22 also includes the two coupling sub-structures 221. In a circuit connection relationship, in each high-frequency unit 2, each coupling sub-structure 221 is separately electrically connected to one balun sub-structure 211 and one radiation arm 231.

When the high-frequency unit 2 serves as a transmit antenna and transmits a signal to the outside, a transmission path of the signal may be as follows: The signal is transmitted to the balun sub-structure 211 by using a feeder and then transmitted to the coupling sub-structure 221 electrically connected to the balun sub-structure 211. When the signal is transmitted to the coupling sub-structure 221, because the coupling sub-structure 221 may transmit a signal whose frequency is higher than the preset threshold and block a signal whose frequency is lower than the preset threshold, the signal whose signal frequency is higher than the preset threshold may continue to be transmitted to the radiation arm 231 electrically connected to the coupling sub-structure 221, and then be radiated to the outside in a form of an electromagnetic wave. A frequency of the emitted electromagnetic wave is always higher than the preset threshold.

In this way, even if the balun structure 21 of the high-frequency unit 2 and the radiation arm 231 of the radiation arm structure 23 may be equivalent to a monopole antenna whose operating frequency is close to a frequency of the low-frequency unit 3, a frequency of an electromagnetic wave generated by the equivalent monopole antenna is always higher than the preset threshold (a frequency of an electromagnetic wave generated by the low-frequency unit 3 is lower than the preset threshold) due to existence of the coupling structure 22. The frequency of the electromagnetic wave generated by the equivalent monopole antenna is staggered from an operating frequency band of the low-frequency unit 3, thereby avoiding interference caused by the equivalent monopole antenna to the signal radiated and transmitted by the low-frequency unit 3 and ensuring normal operation of the low-frequency unit 3.

In a possible implementation, the high-frequency unit 2 further includes a substrate 24. The substrate 24 is vertically disposed on the reflection panel 1. The two radiation arms 231 are symmetrically disposed at one end of the substrate 24 away from the reflection panel 1. The two coupling sub-structures 221 of the coupling structure 22 are symmetrically disposed on a surface of the substrate 24. The two balun sub-structures 211 of the balun structure 21 are symmetrically disposed on the surface of the substrate 24.

The substrate 24 may also be referred to as a balun dielectric board. The substrate 24 is a circuit board configured to carry the balun structure 21. The substrate 24 may be vertically fixedly disposed on the reflection panel 1.

In the solution shown in this embodiment of the present invention, the two radiation arms 231 of the radiation arm structure 23 are disposed at the end of the substrate 24 away from the reflection panel 1. The two radiation arms 231 may be symmetrically disposed, or may be asymmetrically disposed. Symmetrical disposition and asymmetrical disposition of the radiation arm structure 23 are mainly related to a directivity pattern of the multi-band antenna. Structures of the two radiation arms 231 may be the same or different. However, generally, the structures of the two radiation arms 231 are the same for the dipole antenna. The specific structure of the radiation arm 231 may be a conducting wire, or may be a metal sheet-like structure. For example, the radiation arm 231 may be a straight conducting wire, may be a quadrilateral frame that is formed by a conducting wire, or may be a quadrilateral metal sheet.

For ease of description, the following uses an example in which the two radiation arms 231 are symmetrically disposed. A case in which the two radiation arms 231 are asymmetrically disposed is similar to this case. Details are not described again. The two radiation arms 231 are symmetrically disposed. An axis of symmetry of the two radiation arms 231 is a central axis between the two radiation arms 231. The central axis is also a central axis of the high-frequency unit 2. When no special description is provided, the axis of symmetry in a structure described below is the central axis between the two radiation arms 231. A dashed-and-dotted line shown in FIG. 3 is the central axis of the high-frequency unit 2.

As shown in FIG. 3, the two balun sub-structures 211 of the balun structure 21 are disposed on the surface of the substrate 24. When the two radiation arms 231 are symmetrically disposed, the two balun sub-structures 211 may also be symmetrically disposed on the surface of the substrate 24. An axis of symmetry of the two balun sub-structures 211 is the central axis of the high-frequency unit 2. Structures of the two balun sub-structures 211 may be the same or different, as long as the foregoing blocking function can be implemented.

As shown in FIG. 3, the two coupling sub-structures 221 of the coupling structure 22 are disposed on the surface of the substrate 24. Similarly, when the two radiation arms 231 are symmetrically disposed, the two coupling sub-structures 221 may be symmetrically disposed on the surface of the substrate 24. An axis of symmetry of the two coupling sub-structures 221 is the foregoing central axis. The coupling sub-structure 221 has a filtering function. The coupling sub-structure 221 can transmit a signal whose frequency is higher than the preset threshold, and block a signal whose frequency is lower than the preset threshold.

Based on the foregoing description, in each high-frequency unit 2, the substrate 24 is disposed on the reflection panel 1, the two radiation arms 231 of the radiation arm structure 23 may be symmetrically disposed at the end of the substrate 24 away from the reflection panel 1, the two balun sub-structures 211 of the balun structure 21 may be symmetrically disposed on the surface of the substrate 24, and the two coupling sub-structures 221 of the coupling structure 22 may also be symmetrically disposed on the surface of the substrate 24. As shown in FIG. 3, the central axis of the high-frequency unit 2 divides the high-frequency unit 2 into two sides that may be denoted as a first side and a second side. One radiation arm 231, one balun sub-structure 211, and one coupling sub-structure 221 are located on the first side of the high-frequency unit 2; and the other radiation arm 231, the other balun sub-structure 211, and the other coupling sub-structure 221 are located on the second side of the high-frequency unit 2. On each side (the first side or the second side) of the high-frequency unit 2, the coupling sub-structure 221 is separately electrically connected to the balun sub-structure 211 and the radiation arm 231 on the side.

In a possible implementation, the coupling sub-structure 221 includes a first coupling stub 2211 and a second coupling stub 2212 that are coupled to each other. The first coupling stub 2211, the second coupling stub 2212, and the corresponding balun sub-structure 211 are disposed on the same surface of the substrate 24. The first coupling stub 2211 is electrically connected to the corresponding balun sub-structure 211, and the second coupling stub 2212 is electrically connected to the corresponding radiation arm 231.

In the solution shown in this embodiment of the present invention, to implement mutual coupling between the first coupling stub 2211 and the second coupling stub 2212, correspondingly, a distance between the first coupling stub 2211 and the second coupling stub 2212 is less than a preset value. To improve a coupling effect between the first coupling stub 2211 and the second coupling stub 2212, the distances between the first coupling stub 2211 and the second coupling stub 2212 at various locations are equal and are less than the preset value. The first coupling stub 2211, the second coupling stub 2212, and the corresponding balun sub-structure 211 are disposed on the same surface of the substrate 24. The corresponding balun sub-structure 211 indicates a balun sub-structure 211 on a same side of the central axis as the first coupling stub 2211 and the second coupling stub 2212. Similarly, in the electrical connection between the first coupling stub 2211 and the corresponding balun sub-structure 211, the corresponding balun sub-structure 211 indicates a balun sub-structure 211 on the same side of the central axis as the first coupling stub 2211. The second coupling stub 2212 is electrically connected to the corresponding radiation arm 231. The corresponding radiation arm 231 indicates a radiation arm 231 on a same side of the central axis as the second coupling stub 2212.

In a possible implementation, the first coupling stub 2211 and the second coupling stub 2212 each have an open loop structure. The open loop structure of the first coupling stub 2211 is located outside the open loop structure of the second coupling stub 2212. A distance between the open loop structure of the first coupling stub 2211 and the open loop structure of the second coupling stub 2212 is less than a preset value.

In the solution shown in this embodiment of the present invention, to reduce space occupied by the coupling sub-structure 221, correspondingly, the first coupling stub 2211 and the second coupling stub 2212 may be bent to form a circular loop with an opening, or may form an arc-shaped loop with an opening, or may form a quadrilateral loop with an opening, or the like. However, a quadrilateral loop structure with an opening occupies smaller space than a circular loop structure with an opening.

In a possible implementation, an opening direction of the open loop structure of the first coupling stub is the same as that of the open loop structure of the second coupling stub.

In the solution shown in this embodiment of the present invention, to increase a coupling length between the first coupling stub 2211 and the second coupling stub 2212, correspondingly, the opening direction of the first coupling stub 2211 and the opening direction of the second coupling stub 2212 are the same. If the opening directions are different, a length of an opening will be reduced from the coupling length of the coupling sub-structure 221.

In a possible implementation, the coupling sub-structure 221 includes a first coupling stub 2211, a second coupling stub 2212, and a third coupling stub 2213. The third coupling stub 2213 is separately coupled to the first coupling stub 2211 and the second coupling stub 2212. The first coupling stub 2211, the second coupling stub 2212, and the corresponding balun sub-structure 211 are disposed on a first surface of the substrate 24. The third coupling stub 2213 is disposed on a second surface of the substrate 24. The first coupling stub 2211 is electrically connected to the corresponding balun sub-structure 211 (that is located on the same side of the central axis as the first coupling stub 2211). The second coupling stub 2212 is electrically connected to the corresponding radiation arm 231 (that is located on the same side of the central axis as the second coupling stub 2212).

The first coupling stub 2211, the second coupling stub 2212, and the third coupling stub 2213 may be disposed in any shape, for example, may be arc-shaped, may be circular, or may be quadrilateral. A quadrilateral coupling stub occupies smaller space. In this embodiment and the accompanying drawings, the quadrilateral coupling stub may be used as an example. A case of a coupling stub with another shape is similar to that of the quadrilateral coupling stub.

In the solution shown in this embodiment of the present invention, to implement that the third coupling stub 2213 is separately coupled to the first coupling stub 2211 and the second coupling stub 2212, correspondingly, a distance between the third coupling stub 2213 and the first coupling stub 2211 is less than a preset value, and a distance between the third coupling stub 2213 and the second coupling stub 2212 is less than a preset value.

In a possible implementation, a thickness of the substrate 24 is less than a preset value. A distance between the first coupling stub 2211 and the second coupling stub 2212 is greater than a preset value. A first part of the third coupling stub 2213 and the first coupling stub 2211 have a same structure and corresponding locations. A second part of the third coupling stub 2213 and the second coupling stub 2212 have a same structure and corresponding locations.

In the solution shown in this embodiment of the present invention, the third coupling stub 2213 is separately coupled to the first coupling stub 2211 and the second coupling stub 2212 by using the substrate 24. Correspondingly, the thickness of the substrate 24 is less than the preset value. If the first coupling stub 2211 is coupled to the second coupling stub 2212, the third coupling stub 2213 cannot be coupled to the first coupling stub 2211 and the second coupling stub 2212. To avoid this case, correspondingly, the distance between the first coupling stub 2211 and the second coupling stub 2212 is greater than the preset value. To implement that the third coupling stub 2213 is separately connected to the first coupling stub 2211 and the second coupling stub 2212, correspondingly, the first part of the third coupling stub 2213 and the first coupling stub 2211 have the same structure and the corresponding locations; and the second part of the third coupling stub 2213 and the second coupling stub 2212 have the same structure and the corresponding locations.

Based on the foregoing description, for example, the high-frequency unit 2 transmits a signal to the outside. In this case, the signal on the feeder is transmitted to the balun sub-structure 211 and then transmitted to the first coupling stub 2211. The signal is then coupled to the first part of the third coupling stub 2213. Then, the signal is transmitted to the second part of the third coupling stub 2213 along a connection part between the first part and the second part of the third coupling stub 2213. Then, the signal is coupled to the second coupling stub 2212 from the second part of the third coupling stub 2213. Finally, the signal is transmitted to the radiation arm 231 electrically connected to the second coupling stub 2212.

In a possible implementation, the electrical connection is a direct electrical connection or a coupling electrical connection.

In the solution shown in this embodiment of the present invention, the electrical connection may be the direct electrical connection, or may be the coupling electrical connection. The coupling electrical connection may also be referred to as a gap electrical connection in which two structures are not in direct contact with each other but a gap that is less than a preset value exists between the two structures.

In a possible implementation, the coupling length of the coupling sub-structure 221 falls within a preset value range.

In the solution shown in this embodiment of the present invention, a structure that is in the coupling structure 22 and that is used to implement the filtering function of the coupling structure 22 is mainly related to a coupling length. A greater coupling length of the coupling structure 22 indicates a smaller foregoing preset threshold. A person skilled in the art may set the coupling length of the coupling structure 22 based on an operating frequency band of the high-frequency unit 2 and the operating frequency band of the low-frequency unit 3. The coupling length of the coupling structure 22 may be set within a preset value range.

In a possible implementation, the preset value range is 0.15 to 0.45 times of the wavelength corresponding to an intermediate frequency of the operating frequency band of the high-frequency unit 2.

In the solution shown in this embodiment of the present invention, the preset value range may be set to 0.15 to 0.45 times of the wavelength corresponding to the intermediate frequency of the operating frequency band of the high-frequency unit 2, thereby ensuring that the high-frequency unit 2 can normally operate.

According to a second aspect, a communications device is provided. The communications device includes the foregoing multi-band antenna.

The technical solutions provided in the embodiments of the present invention bring the following beneficial effects:

In the embodiments of the present invention, the multi-band antenna includes the at least one high-frequency unit and the at least one low-frequency unit. Each high-frequency unit includes not only the balun structure and the radiation arm structure, but also the coupling structure. The radiation arm structure includes the two radiation arms. The balun structure includes the two balun sub-structures. The coupling structure includes the two coupling sub-structures. The coupling structure is disposed on the connection line between the balun structure and the radiation arm structure. Specifically, in each high-frequency unit, each coupling sub-structure is separately electrically connected to one balun sub-structure and one radiation arm. The coupling structure has a function of transmitting a signal whose frequency is higher than the preset threshold and blocking a signal whose frequency is lower than the preset threshold. In this way, even if the balun structure of the high-frequency unit and the radiation arm of the radiation arm structure may be equivalent to a monopole antenna whose operating frequency is close to the frequency of the low-frequency unit, the frequency of the electromagnetic wave radiated by the equivalent monopole antenna to the outside is always higher than the preset threshold (the frequency of the electromagnetic wave generated by the low-frequency unit is lower than the preset threshold) due to the existence of the coupling structure, thereby staggering from the operating frequency band of the low-frequency unit, so that the equivalent monopole antenna causes a relatively low degree of interference to the signal radiated and transmitted by the low-frequency unit, or even no interference to the signal radiated and transmitted by the low-frequency unit.

| Description of illustrations: |
|---|
| 1. Reflection panel |
| 2. High-frequency unit |
| 3. Low-frequency unit |

-continued

| Description of illustrations: |
|---|
| 21. Balun structure |
| 22. Coupling structure |
| 23. Radiation arm structure |
| 24. Substrate |
| 211. Balun sub-structure |
| 221. Coupling sub-structure |
| 231. Radiation arm |
| 2211. First coupling stub |
| 2212. Second coupling stub |
| 2213. Third coupling stub |

DESCRIPTION OF EMBODIMENTS

Figure 1:
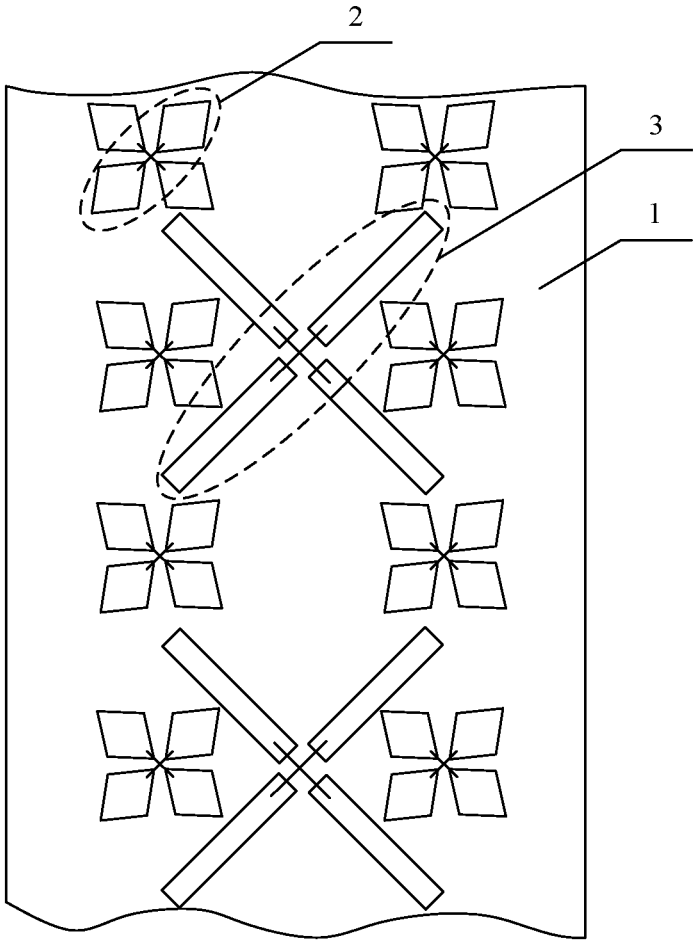
FIG. 1 is a schematic structural diagram of a multi-band antenna according to an embodiment of the present invention.
Figure 2:
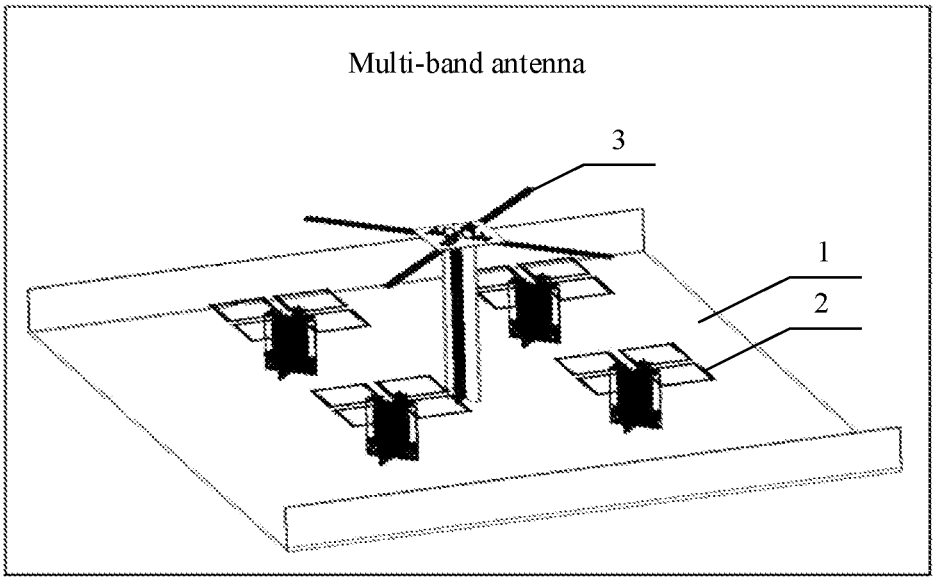
FIG. 2 is a schematic structural diagram of a multi-band antenna according to an embodiment of the present invention.
Figure 3:
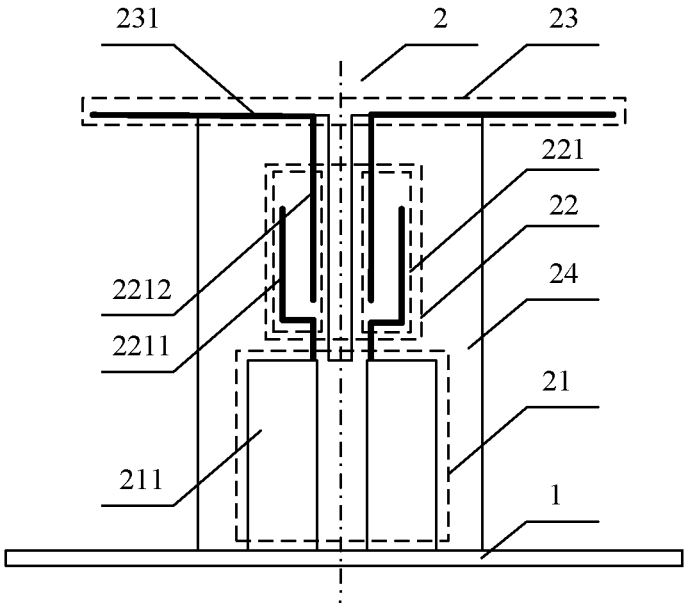
FIG. 3 is a schematic structural diagram of a high-frequency unit according to an embodiment of the present invention.

An embodiment of the present invention provides a multi-band antenna. The multi-band antenna is an antenna having a plurality of operating frequency bands. As shown in FIG. 1 and FIG. 2, the multi-band antenna includes a reflection panel 1, at least one high-frequency unit 2, and at least one low-frequency unit 3. As shown in FIG. 3, each high-frequency unit 2 includes a balun structure 21, a coupling structure 22, and a radiation arm structure 23. The balun structure 21 includes two balun sub-structures 211, the coupling structure 22 includes two coupling sub-structures 221, and the radiation arm structure 23 includes two radiation arms 231. The at least one high-frequency unit 2 and the at least one low-frequency unit 3 are disposed on the reflection panel 1. In each high-frequency unit 2, each coupling sub-structure 221 is separately electrically connected to one balun sub-structure 211 and one radiation arm 231. The coupling sub-structure 221 is configured to: transmit a signal whose frequency is higher than a preset threshold, and block a signal whose frequency is lower than the preset threshold.

Currently, most commonly used antennas are dipole antennas. Correspondingly, the high-frequency unit 2 and the low-frequency unit 3 may also be referred to as dipoles. A dipole antenna is an antenna that includes a pair of symmetrically disposed radiation arms and in which two ends that are of two radiation arms and that are close to each other are separately connected to a feeder.

In implementation, a balun structure is introduced into the dipole antenna. A main reason is as follows: According to an antenna theory, the dipole antenna is a balanced antenna. A coaxial cable is an unbalanced transmission line. If the coaxial cable is directly connected to the dipole antenna, a high-frequency current flows through a sheath of the coaxial cable (according to a transmission principle of the coaxial cable, the high-frequency current flows inside the coaxial cable, and the sheath is a shield layer without a current). In this case, radiation of the dipole antenna is affected (the following case may be imaged: The shield layer of the coaxial cable participates radiation of the electromagnetic wave). Therefore, a balanced-unbalanced converter is added between the dipole antenna and the coaxial cable to curb the current flowing into the sheath of the shield layer of the coaxial cable, that is, to cut off the high-frequency current flowing from the radiation arm into the sheath of the shield layer of the coaxial cable.

As shown in FIG. 1 and FIG. 2, two high-frequency units 2 of the multi-band antenna may be interspersed and disposed on the reflection panel 1, and two low-frequency units 3 may also be interspersed and disposed on the reflection panel 1, to save space of the multi-band antenna. In this embodiment, for ease of description of a structure of the high-frequency unit 2, one high-frequency unit 2 may be used as an example.

As shown in FIG. 3, each high-frequency unit 2 includes not only the balun structure 21 and the radiation arm structure 23, but also the coupling structure 22 disposed on a connection line between the balun structure 21 and the radiation arm structure 23. The coupling structure 22 is configured to: transmit a signal whose frequency is higher than the preset threshold, and block a signal whose frequency is lower than the preset threshold. Because the multi-band antenna belongs to a dipole antenna, the radiation arm structure 23 includes the two radiation arms 231. Correspondingly, the balun structure 21 also includes the two balun sub-structures 211, and the coupling structure 22 also includes the two coupling sub-structures 221. In a circuit connection relationship, in each high-frequency unit 2, each coupling sub-structure 221 is separately electrically connected to one balun sub-structure 211 and one radiation arm 231.

The threshold is preset based on an operating frequency band of the high-frequency unit 2 and an operating frequency band of the low-frequency unit 3. The preset threshold is less than a minimum frequency in the operating frequency band of the high-frequency unit 2, and is greater than a maximum frequency in the operating frequency band of the low-frequency unit 3.

When the high-frequency unit 2 serves as a transmit antenna and transmits a signal to the outside, a transmission path of the signal may be as follows: The signal is transmitted to the balun sub-structure 211 by using a feeder and then transmitted to the coupling sub-structure 221 electrically connected to the balun sub-structure 211. When the signal is transmitted to the coupling sub-structure 221, because the coupling sub-structure 221 may transmit a signal whose frequency is higher than the preset threshold and block a signal whose frequency is lower than the preset threshold, the signal whose signal frequency is higher than the preset threshold may continue to be transmitted to the radiation arm 231 electrically connected to the coupling sub-structure 221, and then be radiated to the outside in a form of an electromagnetic wave. A frequency of the emitted electromagnetic wave is always higher than the preset threshold.

In this way, even if the balun structure 21 of the high-frequency unit 2 and the radiation arm 231 of the radiation arm structure 23 may be equivalent to a monopole antenna whose operating frequency is close to a frequency of the low-frequency unit 3, a frequency of an electromagnetic wave generated by the equivalent monopole antenna is always higher than the preset threshold (a frequency of an electromagnetic wave generated by the low-frequency unit 3 is lower than the preset threshold) due to existence of the coupling structure 22. The frequency of the electromagnetic wave generated by the equivalent monopole antenna is staggered from an operating frequency band of the low-frequency unit 3, so that the equivalent monopole antenna causes a relatively low degree of interference to the signal radiated and transmitted by the low-frequency unit, and even causes no interference to the signal radiated and transmitted by the low-frequency unit, so that the low-frequency unit 3 can normally operate.

Optionally, as shown in FIG. 3, the high-frequency unit 2 further includes a substrate 24. The substrate 24 is vertically disposed on the reflection panel 1. The two radiation arms 231 are symmetrically disposed at one end that is of the substrate 24 and that is away from the reflection panel 1. The two coupling sub-structures 221 of the coupling structure 22 are symmetrically disposed on a surface of the substrate 24. The two balun sub-structures 211 of the balun structure 21 are symmetrically disposed on the surface of the substrate 24.

The substrate 24 may also be referred to as a balun dielectric board. The substrate 24 is a circuit board configured to carry the balun structure 21. The substrate 24 may be vertically fixedly disposed on the reflection panel 1.

In implementation, the two radiation arms 231 of the radiation arm structure 23 are disposed at the end that is of the substrate 24 and that is away from the reflection panel 1. The two radiation arms 231 may be symmetrically disposed, or may be asymmetrically disposed. Symmetrical disposition and asymmetrical disposition of the radiation arm structure 23 are mainly related to a directivity pattern of the multi-band antenna. Structures of the two radiation arms 231 may be the same or different. However, generally, the structures of the two radiation arms 231 are the same for the dipole antenna. The specific structure of the radiation arm 231 may be a conducting wire, or may be a metal sheet-like structure. For example, the radiation arm 231 may be a straight conducting wire, may be a quadrilateral frame that is formed by a conducting wire, or may be a quadrilateral metal sheet.

For ease of description, the following uses an example in which the two radiation arms 231 are symmetrically disposed. A case in which the two radiation arms 231 are asymmetrically disposed is similar to this case. Details are not described again. The two radiation arms 231 are symmetrically disposed. An axis of symmetry of the two radiation arms 231 is a central axis between the two radiation arms 231. The central axis is also a central axis of the high-frequency unit 2. When no special description is provided, the axis of symmetry in the structure described below is the central axis between the two radiation arms 231. A dashed-and-dotted line shown in FIG. 3 is the central axis of the high-frequency unit 2.

As shown in FIG. 3, the two balun sub-structures 211 of the balun structure 21 are disposed on the surface of the substrate 24. When the two radiation arms 231 are symmetrically disposed, the two balun sub-structures 211 may also be symmetrically disposed on the surface of the substrate 24. An axis of symmetry of the two balun sub-structures 211 is the central axis of the high-frequency unit 2. Structures of the two balun sub-structures 211 may be the same or different, as long as the foregoing blocking function can be implemented.

As shown in FIG. 3, the two coupling sub-structures 221 of the coupling structure 22 are disposed on the surface of the substrate 24. Similarly, when the two radiation arms 231 are symmetrically disposed, the two coupling sub-structures 221 may be symmetrically disposed on the surface of the substrate 24. An axis of symmetry of the two coupling sub-structures 221 is the foregoing central axis. The coupling sub-structure 221 has a filtering function. The coupling sub-structure 221 can transmit a signal whose frequency is higher than the preset threshold, and block a signal whose frequency is lower than the preset threshold.

Based on the foregoing description, in each high-frequency unit 2, the substrate 24 is disposed on the reflection panel 1, the two radiation arms 231 of the radiation arm structure 23 may be symmetrically disposed at the end that is of the substrate 24 and that is away from the reflection panel 1, the two balun sub-structures 211 of the balun structure 21 may be symmetrically disposed on the surface of the substrate 24, and the two coupling sub-structures 221 of the coupling structure 22 may also be symmetrically disposed on the surface of the substrate 24. As shown in FIG. 3, the central axis of the high-frequency unit 2 divides the high-frequency unit 2 into two sides that may be denoted as a first side and a second side. One radiation arm 231, one balun sub-structure 211, and one coupling sub-structure 221 are located on the first side of the high-frequency unit 2; and the other radiation arm 231, the other balun sub-structure 211, and the other coupling sub-structure 221 are located on the second side of the high-frequency unit 2. On each side (the first side or the second side) of the high-frequency unit 2, the coupling sub-structure 221 is separately electrically connected to the balun sub-structure 211 and the radiation arm 231 on the side.

The electrical connection may be a direct electrical connection, or may be a coupling electrical connection. A coupling electrical connection may also be referred to as a gap electrical connection. The two structures are not in direct contact with each other. Instead, a gap that is less than a preset value exists between the two structures.

In implementation, a structure that is in the coupling structure 22 and that is used to implement the filtering function of the coupling structure 22 is mainly related to the coupling length. A greater coupling length of the coupling structure 22 indicates a smaller preset threshold. A person skilled in the art may set the coupling length of the coupling structure 22 based on an operating frequency band of the high-frequency unit 2 and the operating frequency band of the low-frequency unit 3. The coupling length of the coupling structure 22 may be set within a preset value range. For example, the preset value range may be set to 0.15 to 0.45 times of a wavelength corresponding to an intermediate frequency of the operating frequency band of the high-frequency unit 2.

The following describes several coupling structures 22 with different shapes in detail. However, specific shapes of the coupling structures 22 are not limited to the following cases, as long as the coupling structures 22 can implement the function of transmitting a signal whose frequency is higher than the preset threshold and blocking a signal whose frequency is less than the preset threshold. The shape of the coupling structure 22 is set mainly to save space occupied by the coupling structure 22.

A possible case may be as follows: As shown in FIG. 3, the coupling sub-structure 221 may include a first coupling stub 2211 and a second coupling stub 2212 that are coupled to each other. To implement coupling between the first coupling stub 2211 and the second coupling stub 2212, correspondingly, a distance between the first coupling stub 2211 and the second coupling stub 2212 is less than a preset value. When the distance between the first coupling stub 2211 and the second coupling stub 2212 is less than the preset value, to improve a coupling effect of the first coupling stub 2211 and the second coupling stub 2212, distances between the first coupling stub 2211 and the second coupling stub 2212 at various locations are equal and are less than the preset value. One of the first coupling stub 2211 and the second coupling stub 2212 is electrically connected to the corresponding balun sub-structure 211, and the other is electrically connected to the corresponding radiation arm 231. For example, the first coupling stub 2211 is electrically connected to the corresponding balun sub-structure 211 (that is located on a same side of the central axis as the first coupling stub 2211), and the second coupling stub 2212 is electrically connected to the corresponding radiation arm 231 (that is located on a same side of the central axis as the second coupling stub 2212).

The first coupling stub 2211 and the second coupling stub 2212 may be disposed on the same surface of the substrate 24, or may be disposed on different surfaces. Details may be as follows:

When the first coupling stub 2211 and the second coupling stub 2212 are disposed on the same surface of the substrate 24, one of the first coupling stub 2211 and the second coupling stub 2212 is electrically connected to the corresponding balun sub-structure 211, and the other is electrically connected to the corresponding radiation arm 231. Correspondingly, the balun sub-structure 211 is also disposed on the surface that is of the substrate 24 and on which the first coupling stub 2211 and the second coupling stub 2212 are located. In other words, the first coupling stub 2211, the second coupling stub 2212, and the corresponding balun sub-structure 211 (that is located on a same side of the central axis as the coupling sub-structure 221) are all disposed on the same surface of the substrate 24. When the first coupling stub 2211 and the second coupling stub 2212 are located on the same surface of the substrate 24, to implement coupling between the first coupling stub 2211 and the second coupling stub 2212, correspondingly, the distance between the first coupling stub 2211 and the second coupling stub 2212 is less than the preset value, and the coupling length of the coupling structure 22 in the structure may be a coupling length between the first coupling stub 2211 and the second coupling stub 2212.

When the first coupling stub 2211 and the second coupling stub 2212 are respectively disposed on different surfaces of the substrate 24, that is, the first coupling stub 2211 may be disposed on a first surface of the substrate 24, and the second coupling stub 2212 is disposed on a second surface of the substrate 24, one of the first coupling stub 2211 and the second coupling stub 2212 is electrically connected to the corresponding balun sub-structure 211, where the first surface is opposite to the second surface. Correspondingly, if the first coupling stub 2211 is electrically connected to the balun sub-structure 211, the first coupling stub 2211 and the balun sub-structure 211 are located on the same surface of the substrate 24. If the second coupling stub 2212 is electrically connected to the balun sub-structure 211, the second coupling stub 2212 and the balun sub-structure 211 are located on the same surface of the substrate 24. The first coupling stub 2211 may be disposed on the first surface of the substrate 24, and the second coupling stub 2212 is disposed on the second surface of the substrate 24. In this case, to implement coupling between the first coupling stub 2211 and the second coupling stub 2212, correspondingly, the first coupling stub 2211 and the second coupling stub 2212 have a same structure and corresponding locations. When the second coupling stub 2212 is disposed on the second surface of the substrate 24, a space area occupied by the coupling structure 22 on the substrate 24 may be saved. The coupling length of the coupling structure 22 in this structure may be the minimum circumference of the circumference of the first coupling stub 2211 and the circumference of the second coupling stub 2212.

Figure 4:
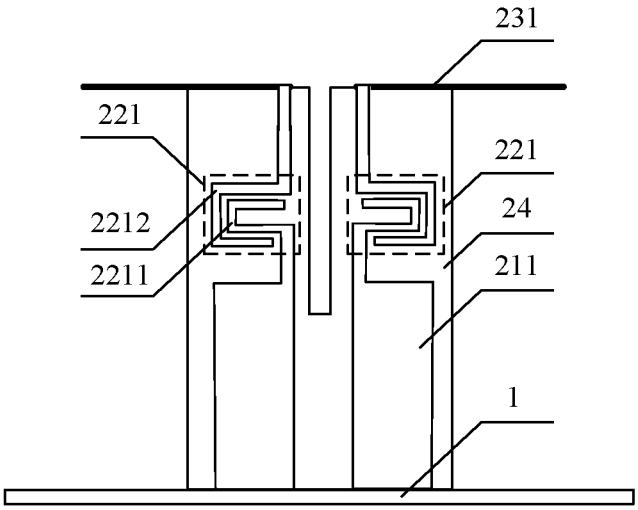
FIG. 4 is a schematic structural diagram of a high-frequency unit according to an embodiment of the present invention.

The first coupling stub 2211 and the second coupling stub 2212 are directly vertically disposed on the substrate 24. Therefore, the coupling structure 22 occupies relatively large space of the substrate 24. To save space, correspondingly, the first coupling stub 2211 and the second coupling stub 2212 may be bent. As shown in FIG. 4, the first coupling stub 2211 and the second coupling stub 2212 each have an open loop structure. The open loop structure of the first coupling stub 2211 is located outside the open loop structure of the second coupling stub 2212. A distance between the open loop structure of the first coupling stub 2211 and the open loop structure of the second coupling stub 2212 is less than a preset value.

In implementation, the first coupling stub 2211 and the second coupling stub 2212 may be bent to form a circular loop with an opening, or may be bent to form an arc-shaped loop with an opening, or may be bent to form a quadrilateral loop with an opening, or the like. However, a quadrilateral loop structure with an opening occupies smaller space than a circular loop structure with an opening. To increase the coupling length between the first coupling stub 2211 and the second coupling stub 2212, correspondingly, an opening direction of the open loop structure of the first coupling stub 2211 and an opening direction of the open loop structure of the second coupling stub 2212 are the same. If the opening directions are different, a length of an opening will be reduced from the coupling length of the coupling sub-structure 221.

Optionally, to further reduce the space occupied by the coupling structure 22 on the substrate 24, correspondingly, the first coupling stub 2211 may be disposed on the first surface of the substrate 24, the second coupling stub 2212 may be disposed on the second surface of the substrate 24, and the location of the first coupling stub 2211 corresponds to the location of the second coupling stub 2212. The first surface of the substrate 24 is opposite to the second surface of the substrate 24. The first coupling stub 2211 and the second coupling stub 2212 are coupled by using a thickness of the substrate 24. To meet coupling, the thickness of the substrate 24 is correspondingly less than a preset value. If the balun sub-structure 211 is electrically connected to the first coupling stub 2211, the balun sub-structure 211 is disposed on the surface that is of the substrate 24 and on which the first coupling stub 2211 is located, that is, the first surface of the substrate 24. If the balun sub-structure 211 is electrically connected to the second coupling stub 2212, the balun sub-structure 211 is disposed on the surface that is of the substrate 24 and on which the second coupling stub 2212 is located, that is, the second surface of the substrate 24.

In this structure, the coupling length of the coupling structure 22 is the minimum circumference of the circumference of the first coupling stub 2211 and the circumference of the second coupling stub 2212. For example, if the first coupling stub 2211 and the second coupling stub 2212 have the same structure, the coupling length is the circumference of the first coupling stub 2211 or the second coupling stub 2212. If the circumference of the first coupling stub 2211 is less than the circumference of the second coupling stub 2212, the coupling length is the circumference of the first coupling stub 2211.

When the coupling structure 22 belongs to one-level coupling, the coupling structure 22 may further include two-level coupling or multi-level coupling, where the one-level coupling is coupling for one time. The following describes the coupling structure 22 with two-level coupling.

Figure 5:
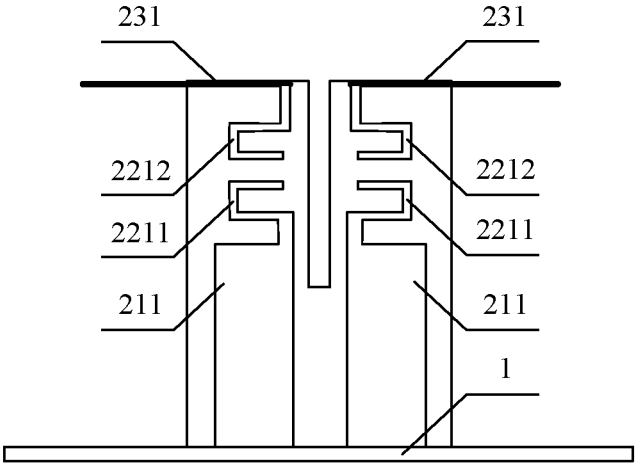
FIG. 5 is a schematic structural diagram of a high-frequency unit according to an embodiment of the present invention.
Figure 6:
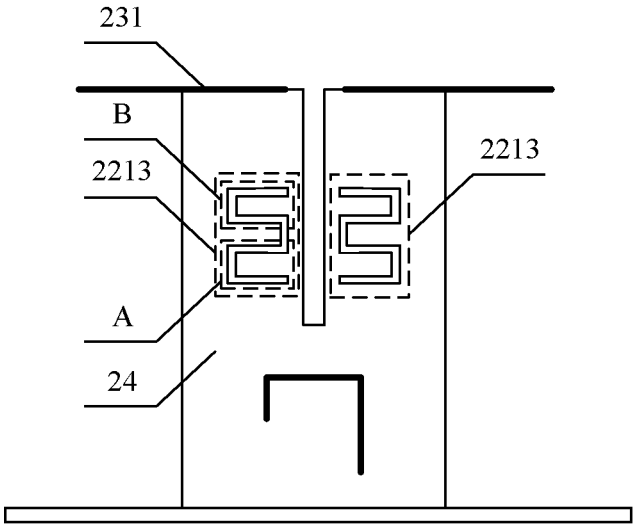
FIG. 6 is a schematic structural diagram of a high-frequency unit according to an embodiment of the present invention.

FIG. 5 is a schematic structural diagram of the first surface of the substrate 24. FIG. 6 is a schematic structural diagram of the second surface of the substrate 24. The coupling sub-structure 221 includes a first coupling stub 2211, a second coupling stub 2212, and a third coupling stub 2213. The third coupling stub 2213 is separately coupled to the first coupling stub 2211 and the second coupling stub 2212. The first coupling stub 2211, the second coupling stub 2212, and the corresponding balun sub-structure 211 are disposed on a first surface of the substrate 24. The third coupling stub 2213 is disposed on a second surface of the substrate 24. The first coupling stub 2211 is electrically connected to the corresponding balun sub-structure 211 (that is located on a same side of the central axis as the first coupling stub 2211). The second coupling stub 2212 is electrically connected to the corresponding radiation arm 231 (that is located on a same side of the central axis as the second coupling stub 2212).

The first coupling stub 2211, the second coupling stub 2212, and the third coupling stub 2213 may be disposed in any shape, for example, may be arc-shaped, may be circular, or may be quadrilateral. A quadrilateral coupling stub occupies smaller space. In this embodiment and the accompanying drawings, the quadrilateral coupling stub may be used as an example. A case of a coupling stub with another shape is similar to that of the quadrilateral coupling stub.

In implementation, the third coupling stub 2213 is separately coupled to the first coupling stub 2211 and the second coupling stub 2212 via the substrate 24. Correspondingly, the thickness of the substrate 24 is less than a preset value. If the first coupling stub 2211 is coupled to the second coupling stub 2212, the third coupling stub 2213 cannot be coupled to the first coupling stub 2211 and the second coupling stub 2212. To avoid this case, correspondingly, a distance between the first coupling stub 2211 and the second coupling stub 2212 is greater than the preset value. To implement that the third coupling stub 2213 is separately connected to the first coupling stub 2211 and the second coupling stub 2212, correspondingly, a first part of the third coupling stub 2213 and the first coupling stub 2211 have the same structure and the corresponding locations; and a second part of the third coupling stub 2213 and the second coupling stub 2212 have the same structure and the corresponding locations. In FIG. 6, A represents the first part of the third coupling stub 2213, and B represents the second part of the third coupling stub 2213.

Based on the foregoing description, in a case where the high-frequency unit 2 transmits a signal to the outside, the signal on the feeder is transmitted to the balun sub-structure 211 and then transmitted to the first coupling stub 2211; the signal is then coupled to the first part of the third coupling stub 2213; then, the signal is transmitted to the second part of the third coupling stub 2213 along a connection part between the first part and the second part of the third coupling stub 2213; next, the signal is coupled to the second coupling stub 2212 from the second part of the third coupling stub 2213; and finally, the signal is transmitted to the radiation arm 231 electrically connected to the second coupling stub 2212.

In the embodiments of the present invention, the multi-band antenna includes the at least one high-frequency unit and the at least one low-frequency unit. Each high-frequency unit includes not only the balun structure and the radiation arm structure, but also the coupling structure. The radiation arm structure includes two radiation arms. The balun structure includes two balun sub-structures. The coupling structure includes two coupling sub-structures. The coupling structure is disposed on the connection line between the balun structure and the radiation arm structure. Specifically, in each high-frequency unit, each coupling sub-structure is separately electrically connected to one balun sub-structure and one radiation arm. The coupling structure has a function of transmitting a signal whose frequency is higher than the preset threshold and blocking a signal whose frequency is lower than the preset threshold. In this way, even if the balun structure of the high-frequency unit and the radiation arm of the radiation arm structure may be equivalent to a monopole antenna whose operating frequency is close to the frequency of the low-frequency unit, the frequency of the electromagnetic wave radiated by the equivalent monopole antenna to the outside is always higher than the preset threshold (the frequency of the electromagnetic wave generated by the low-frequency unit is lower than the preset threshold) due to existence of the coupling structure, thereby staggering from the operating frequency band of the low-frequency unit, so that the equivalent monopole antenna causes a relatively low degree of interference to the signal radiated and transmitted by the low-frequency unit, or even no interference to the signal radiated and transmitted by the low-frequency unit.

An embodiment of the present invention further provides a communications device. The communications device includes the foregoing multi-band antenna. The multi-band antenna includes at least one high-frequency unit and at least one low-frequency unit. Each high-frequency unit includes not only a balun structure and a radiation arm structure, but also a coupling structure. The radiation arm structure includes two radiation arms. The balun structure includes two balun sub-structures. The coupling structure includes two coupling sub-structures. The coupling structure is disposed on a connection line between the balun structure and the radiation arm structure. Specifically, in each high-frequency unit, each coupling sub-structure is separately electrically connected to one balun sub-structure and one radiation arm. The coupling structure has a function of transmitting a signal whose frequency is higher than a preset threshold and blocking a signal whose frequency is lower than the preset threshold. In this way, even if the balun structure of the high-frequency unit and the radiation arm of the radiation arm structure may be equivalent to a monopole antenna whose operating frequency is close to the frequency of the low-frequency unit, a frequency of an electromagnetic wave radiated by the equivalent monopole antenna to the outside is always higher than the preset threshold (a frequency of an electromagnetic wave generated by the low-frequency unit is lower than the preset threshold) due to existence of the coupling structure, thereby staggering from an operating frequency band of the low-frequency unit, so that the equivalent monopole antenna causes a relatively low degree of interference to a signal radiated and transmitted by the low-frequency unit, and even causes no interference to the signal radiated and transmitted by the low-frequency unit.

The foregoing description is merely one embodiment of the present invention, but is not intended to limit this application. Any modification, equivalent replacement, or improvement made without departing from the spirit and principle of this application shall fall within the protection scope of this application.

What is claimed is:

1. A multi-band antenna, wherein the multi-band antenna comprises a reflection panel, at least one high-frequency unit, and at least one low-frequency unit, each high-frequency unit comprises a balun structure, a coupling structure, and a radiation arm structure, the balun structure comprises two balun sub-structures, the coupling structure comprises two coupling sub-structures, and the radiation arm structure comprises two radiation arms, wherein the at least one high-frequency unit and the at least one low-frequency unit are disposed on the reflection panel;

in each high-frequency unit, each coupling sub-structure is separately electrically connected to one balun sub-structure and one radiation arm; and the coupling sub-structure is configured to: transmit a signal whose frequency is higher than a preset threshold, and block a signal whose frequency is lower than the preset threshold, wherein the coupling sub-structure comprises a first coupling stub and a second coupling stub that are coupled to each other, wherein the first coupling stub, the second coupling stub and the corresponding balun sub-structure are disposed on the same surface of the substrate; and the first coupling stub is electrically connected to the corresponding balun sub-structure via a first electrical connection, and the second coupling stub is electrically connected to the corresponding radiation arm via a second electrical connection.

2. The multi-band antenna according to claim 1, wherein the high-frequency unit further comprises a substrate, and the substrate is vertically disposed on the reflection panel; and the two radiation arms are symmetrically disposed on one end that is of the substrate and that is away from the reflection panel, the two coupling sub-structures of the coupling structure are symmetrically disposed on a surface of the substrate, and the two balun sub-structures of the balun structure are symmetrically disposed on the surface of the substrate.

3. The multi-band antenna according to claim 1, wherein the first coupling stub and the second coupling stub each have an open loop structure, the open loop structure of the first coupling stub is located outside the open loop structure of the second coupling stub, and a distance between the open loop structure of the first coupling stub and the open loop structure of the second coupling stub is less than a first preset value.

4. The multi-band antenna according to claim 3, wherein an opening direction of the open loop structure of the first coupling stub is the same as that of the open loop structure of the second coupling stub.

5. The multi-band antenna according to claim 2, wherein the coupling sub-structure further comprises a third coupling stub, wherein the third coupling stub is separately coupled to the first coupling stub and the second coupling stub;

the first coupling stub, the second coupling stub, and the corresponding balun sub-structure are disposed on a first surface of the substrate, and the third coupling stub is disposed on a second surface of the substrate.

6. The multi-band antenna according to claim 5, wherein a thickness of the substrate is less than a second preset value, and a distance between the first coupling stub and the second coupling stub is greater than a third preset value; and a first part of the third coupling stub and the first coupling stub have a same structure and a location of the first part of the third coupling stub corresponds to a location of the first coupling stub; and a second part of the third coupling stub and the second coupling stub have a same structure and a location of the second part of the third coupling stub corresponds to a location of the second coupling stub.

7. The multi-band antenna according to claim 1, wherein the first and second electrical connection are a direct electrical connection or a coupling electrical connection.

8. The multi-band antenna according to claim 1, wherein a coupling length of the coupling sub-structure falls within a preset value range, and wherein the coupling length of the coupling sub-structure is related to the preset threshold which is higher than an operating frequency band of the low frequency unit.

9. The multi-band antenna according to claim 8, wherein the preset value range is 0.15 to 0.45 times of a wavelength corresponding to an intermediate frequency of an operating frequency band of the high-frequency unit.

10. A communications device, wherein the communications device comprises the multi-band antenna according to claim 1.

* * * * *